United States Patent [19]

Miyawaki et al.

[11] Patent Number: 4,728,401

[45] Date of Patent: Mar. 1, 1988

[54] ELECTROLYTIC POST-TREATMENT OF PHOSPHATED SURFACE

[75] Inventors: Toshi Miyawaki, Yokohama; Atsunori Yoshida; Yoshikazu Saito, both of Tokyo, Japan

[73] Assignee: Nihon Parkerizing Co., Ltd., Tokyo, Japan

[21] Appl. No.: 40,432

[22] Filed: Apr. 20, 1987

[30] Foreign Application Priority Data

Apr. 26, 1986 [JP] Japan ..... 61-95909

[51] Int. Cl.[4] ..... C25D 11/00

[52] U.S. Cl. ..... 204/56.1; 204/38.1

[58] Field of Search ..... 204/38.1, 56.1, 97, 204/29, 35.1, 37.6

[56] References Cited

U.S. PATENT DOCUMENTS 4,137,132 1/1979 Ward et al. ..... 204/56.1

4,547,268 10/1985 Bruno ..... 204/56.1

*Primary Examiner*—R. L. Andrews

*Attorney, Agent, or Firm*—Arthur E. Kluegel

[57] ABSTRACT

An improved process for preparing a phosphated metal surface for painting comprises electrolyzing the surface as cathode in an aqueous solution containing hexavalent and trivalent chromium in specified concentrations and weight ratios.

13 Claims, No Drawings

ELECTROLYTIC POST-TREATMENT OF PHOSPHATED SURFACE

BACKGROUND OF THE INVENTION

The present invention concerns a method for the post-treatment of a metal surface pretreated with phosphating solution, wherein a surface to be painted, in particular, to be cathodically electropainted is phosphate treated prior to painting and the surface thus treated is subjected to cathodic electrolysis treatment by dipping it into chromating solution or with flow coating of chromating solution which provides the surface with excellent corrosion resistance and paintability.

It is a generally known technology to apply chromium-based treatment as a post-treatment after phosphate treatment in order to enhance the corrosion resistance and adhesion of subsequently applied paint film. As a post-treatment solution, chromium-free solutions have been developed in various types as alternatives for chromium-based solutions. In all these post-treatment methods, the surface to be treated is either sprayed with the post-treatment solution or dipped into it.

In the process of phosphate treatment of a car body, chromium-based rinsing has been usually employed in western countries. In Japan, in contrast, chromium rinsing has not been employed for the reason that it requires an additional treatment stage together with waste solution treatment for disposal; this entails increasing expense.

While the adoption of chromium-based rinsing in the pretreatment process prior to electropainting, particularly cathodic electropainting, can afford improved corrosion resistance and paint adhesion after painting, it may still cause paint film blister on surface areas where rinsing solution exists in concentration if the work being treated, in the case of car body specifically, is not water-rinsed after chromic acid treatment. Therefore water rinsing is an indispensable condition. However, water rinsing may reduce the corrosion resistance in half. For this reason there is a limit to the benefits to be obtained from chromium-based rinsing, so that corrosion resistance performance is greatly dependent on the quality of zinc phosphate coating formed in the phosphating process prior to chromium-based rinsing; specifically in the case of cathodic electropainting.

As publications that concern zinc phosphate conversion treatment, there are, for example, Japanese Patent Publications Sho-58-11515/1983 which discloses a treatment solution for forming zinc phosphate coating as a base coating suitable to cathodic electropainting and Japanese Patent Publications Sho-58-11513/1983 and Sho-58-11514/1983 which disclose alternate compositions and methods for the treatment solution. In practical application of these inventions, however, there is a problem that a high quality coating, that is, of dense, plate-like crystals and having alkali resistance as claimed by the inventors of the above patents, is hard to form with stability on a car body surface exterior as well as interior, which may accordingly give rise to variation of corrosion resistance and paint film adhesion after painting.

The corrosion resistance of car is of high importance for the car body underside. The car body exterior such as the fender, door, quarterpanel etc. also requires superior paint adhesion which is of essential importance. In both cases high quality is required and in order to satisfy such requirements it is necessary to effect stringent control on the conditions of the phosphate treatment process.

The present invention aims at solving the aforementioned problems and intends to provide an excellent method of post-treatment for a car body pretreated with phosphate particularly for one to be followed by cathodic electropainting.

SUMMARY OF THE INVENTION

The present invention is characterized in that a metal surface treated with phosphate is subjected to a cathodic electrolysis treatment with a chromating solution wherein $Cr^{6+}$ ion content is 0.05–10.0 g/l and $Cr^{3+}$ ion/$Cr^{6+}$ ion weight ratio is less than 1.0. In the practical application, the first step is to clean the metal surface with alkaline cleaning solution then with water rinsing, preferably with multi-stage water rinsing. Thereafter, the surface is surface conditioned with surface conditioning solution preferably with one containing a Ti colloid, followed by phosphate coating with a zinc phosphate base conversion treatment solution as a paint base coating as is known publicly.

In the present invention, the compositions of phosphating solution, treating condition etc. are not specified; any one composition and method that can form a dense phosphate coating on the work being treated is usable. After the formation of phosphate coating, water rinsing preferably of multiple stages is effected and then cathodic electrolysis treatment by means of chromating solution according to the present invention is conducted. After this electrolysis treatment, water rinsing or water rinsing plus deionized water rinsing is done followed by drying-off according to the necessity. Then the process moves to the painting stage, in particular cathodic electropainting.

The present invention is not confined to a car body consisting only of cold rolled steel sheet; the effect of the present invention is also attained for a car body comprising also zinc or zinc alloy plated steel and/or aluminum sheet as assembly parts. The method provided by the present invention is also effective applicable to metallic goods other than a car body.

DETAILED DESCRIPTION OF THE INVENTION

Chromate treatment solution used in the present invention (hereafter referred to as "Chromating Solution") means a chromate solution hitherto in use for post treatment wherein $Cr^{6+}$ ion content and $Cr^{3+}$ ion/$Cr^{6+}$ ion weight ratio are adjusted respectively to 0.05–10.0 g/l and less than 1.0. Hexavalent chromium may be supplied in form of anhydrous chromic acid and/or its alkali salts, alkali earth salts or ammonium salt etc. The range of $Cr^{6+}$ ion concentration is preferably 0.05–10.0 g/l, more preferably 0.2–3.0 g/l. In case of less than 0.05 g/l, coulomb efficiency lowers in cathodic electrolysis treatment and, as a result, the portions of the surface which are lacking in the phosphate coating, such as pinholes, undergo insufficient chromate formation in the treatment; the amount of chromium is not enough. This results in less than desired improvement in the performance of a car body in corrosion resistance, corrosion resistance after painting and paint adhesion. In case of higher than 10.0 g/l, subsequent water rinsing becomes insufficient, which often causes blisters on painted surface, resulting in poor appearance. Further, there is a risk that paint adhesion after water soaking (wet adhesion) may degrade. Also, from an economical viewpoint as well as from the aspect of rinse water effluent disposal, such high $Cr^{6+}$ ion content is not preferable.

Next, $Cr^{3+}$ ion, when contained in chromating solution brings about stabilization in the painted work performance, however, the content of $Cr^{3+}$ ion should be such that $Cr^{3+}$ ion/$Cr^{6+}$ ion weight ratio is less than 1.0. If this value exceeds 1.0, the treatment solution becomes unstable and sludge formation increases. It should be noted here that the most favorable range of $Cr^{3+}$ ion/$Cr^{6+}$ ion ratio is 0.1–0.5.

Colloidal silica may be added to the "chromating solution", at a concentration of 0.01–5.0 g/l to improve paint film performance. If it is less than 0.01 g/l the improvement on paint film adhesion is not appreciable, while higher than 5.0 g/l does not bring about any further effect on improving performance and economically is rather unfavorable. The amount of colloidal silica to be added is preferably 0.1–2 g/l.

Phosphate ion may be added to the "chromating solution" at a concentration of 0.01–2 g/l to improve electroconductivity of this treatment solution and enhance chromate coating adhesion. This is effective to improve "wet adhesion" after painting and corrosion resistance of the paint film. Phosphate ion concentration lower than 0.01 g/l does not appreciably improve electroconductivity; a concentration higher than 2.0 g/l, in turn, does not provide any further improvement on electroconductivity and causes painted work undergo blister with ease, because of insufficient water rinsing. Within the mode of practice that the present invention concerns, a range from 0.2 to 1.0 g/l is preferable. It should be noted that coexistence of aforementioned colloidal silica and phosphate ion can afford a synergistic effect.

Optionally, one may also include in the chromating treatment fluorine compounds, boron compounds sulphuric acid and sulphates besides aforementioned inorganic substances.

Water soluble high molecular weight compounds may also be added to the "chromating solution", at a concentration of 0.01–5.0 g/l. This addition can provide the chromate coating formed on the pinhole portion of phosphate coating with the highest bond strength. The water soluble resin deposited on the above said pinhole portion is hard to remove even by the water rinsing and is enhanced in bond strength by the drying-off that follows. A concentration lower than 0.01 g/l decreases the effect of strengthening the bond of chromate coating formed on the pinhole portion of phosphate coating, while one exceeding 5 g/l impairs the paint film appearance after electrodeposit coating due to insufficient water rinsing. The amount of water soluble resin is preferably 0.2–2.0 g/l. As water soluble resin, polyacrylic, polyurethane base resins or the like are mentionable, out of which one or more kinds are used. However water soluble polymer is not hereby limited. Other water soluble cationic resin than the above-mentioned, if being stable in the "chromating solution", is usable, since addition of them followed by cathodic electrolysis treatment can also exert a sealing effect for the phosphate coating. Precaution should be paid in this case that, without appropriate control of the amount of water soluble cationic polymer and the electrolysis condition, the coating may be made greater in electric insulation, interfering with the electropainting step.

Considering the pH value of the "chromating solution", lower than 1.5 makes the phosphate coating dissolve greatly while higher than 5.0 makes the treatment solution unstable, leading to excess sludge generation. For this reason a pH value within 1.5–5.0 is preferable, and the most preferable range is 3.5–4.5.

With respect to pH control method, lowering the pH is done by adding anhydrous chromic acid and/or phosphoric acid, wherein the addition condition should be for $Cr^{6+}$ ion and phosphate ion not to exceed respectively 0.05–10 g/l and 0.01–2.0 g/l while raising the pH value can be done by adding alkali metal hydroxide or aqueous ammonia.

Next, as the "chromating solution" temperature for cathodic electrolysis treatment, a temperature in the range from ambient (15° C.) to 50° C. is preferable, and more preferable is a range from 20° to 40° C.

All surfaces will be improved by the treatment of this invention. However, those parts that require high corrosion resistance after painting and superior paint adhesion, such as outer side panels of an auto body (both sides), underfloor panels etc. are especially benefited by this treatment, since it contributes to improving the corrosion resistance of edge portions as well as the above-mentioned parts thus treated. The cathodic electrolysis treatment in the present invention can exert its highest effect on the surface of an auto body placed adjacent to the anodic plate. Therefore, for the parts that require higher corrosion resistance after painting and paint adhesion, it is desirable to locate them adjacent to the anode.

With respect to current density for the cathodic electrolysis treatment, too low a value takes too long to attain a prescribed amount of chromium in the coating, while too high a value frequently causes gas evolution at the cathode and economically is not favorable. Accordingly the range is 0.01–0.5 A/dm$^2$, preferably 0.03–0.3 A/dm$^2$.

As to time period for electrolysis, a value usually 2–120 seconds, preferably 10–30 seconds is sufficient to permit forming a chromate coating having a value within 4 to 25 mg/m$^2$ of chromium. An alternative method is to control the coulomb value for the cathodic electrolysis treatment within 0.2–30 coulomb/dm$^2$, preferably 0.6–7.0 coulomb/dm$^2$: a value less than 0.2 coulomb/dm$^2$ needs a long time to obtain a prescribed amount of chromium in the coating, while that exceeding 30 coulomb/dm$^2$ may frequently cause gas evolution at the cathode and economically is unfavorable.

The chromium deposited should be in the range of 4 to 100 mg/m$^2$. In case of deposition lower than 4 mg/m$^2$, the effect on improving corrosion resistance after painting and paint adhesion is not appreciable, while a value higher than 100 mg/m$^2$ does not provide any further improvement and is economically unfavorable.

After the described electrolysis rinsing, the surface is DI water rinsed and, according to the necessity, dried off. It is then transferred to the painting stage specifically to the cathodic electropainting stage.

In the following description, Examples for the present invention and Comparative Examples are presented to concretely explain the advantages of the present invention.

EXAMPLE

1. Test panel
   (a) Cold rolled steel quality: SPCC-SD JIS-G-3141
dimension: 70×150×0.8 mm (b) Electroplated steel
quality: Electrogalvanized C.Wt 20 g/m$^2$
dimension: 70×150×0.8 mm (c) Alloy plated steel
quality: Zn-Ni alloy electroplated C.Wt/20 g/m$^2$ (Ni 12%)
dimension: 70×150×0.8 mm (d) Aluminum
quality: JIS-7075-T6
dimension: 70×150×0.8 mm 2. Preparation of treatment solutions (a) Alkali cleaner
Total alkalinity: 15±1 pt
(Strength is determined by titrating 10 ml sample solution with 0.1N $H_2SO_4$ titrating solution and bromophenol blue indicator.)

(b) Aqueous solution for surface conditioning
15 g/l (aqueous solution containing colloidal titanium as the main constituent)

(c) Phosphate conversion treatment solution
(Aqueous solution containing zinc phosphate as the main constituent)
Free acidity 0.9±0.1 pt
(Strength is determined by titrating 10 ml sample solution with 0.1N NaOH titrating solution and bromophenol blue indicator)
Total acidity 18±1 pt
(Strength is determined by titrating 10 ml sample solution with 0.1N NaOH titrating solution and phenol-phthalein indicator)
Concentration of accelerator: 1.2±0.2 pt
(Saccharometer)

(d) Post-treatment

The composition and condition for the chromate post-treatment solution are as indicated in Table 1.

3. Method of Treatment (a) Alkali cleaning: 50±2° C. 180 sec. dipping
(b) Water rinsing: city water room temp. 20 sec. spray
(c) Surface conditioning: room temp. 20 sec. spray
(d) Phosphating: 53±2° C. 120 sec. dipping
(e) Water rinsing: same as (b) in the above
(f) Post-treatment: examples are respectively shown for the chromate post-treatment in Table 1.
(g) Water rinsing: same as (b) in the above
(h) DI water rinsing: DI water having a specific electric resistance higher than 5×10$^5$ Ωcm, room temp. 15 sec. spray
(i) Drying off: 110° C. 120 sec.

4. Cathodic electropainting (a) Electron 9200 was used (product of Kansai Paint Co., Ltd.): Electrodeposition at 250 V for 180 sec.
(b) Water rinsing: city water, room temp. 20 sec. spray
(c) DI water rinsing: DI water having a specific electric resistance higher than 5×10$^5$ Ωcm, room temp. 5 sec. spray
(d) Baking: 175° C. 30 min.

5. Intermediate coating

Melaminealkyd base resin paint: AMILAC N-2 sealer (product of Kansai Paint) was applied by air spray to 30μ dry film thickness. After setting for 10–20 min. baking was done at 140° C. for 30 minutes.

6. Top coating

Melaminealkyd base resin paint: AMILACKWHITE M3 (product of Kansai Paint) was applied by air spray to 40μ dry film thickness. After setting for 10–20 min. it was baked at 140° C. for 30 minutes.

The performance after painting is as indicated in Table 2.

TABLE 1A

| | Example | | | | | | |
|---|---|---|---|---|---|---|---|
| | 1 | 2 | 3 | 4 | 5 | 6 | 7 |
| Steel Sheet | CRS | EG | Electro-Zn/Ni | A 1 | CRS | EG | Electro-Zn/Ni |
| Solution composition of chromate post-treatment | | | | | | | |
| $Cr^{6+}$ ion (g/l) | 0.4 | 0.3 | 0.5 | 0.2 | 0.25 | 0.2 | 0.3 |
| $Cr^{3+}$ ion (g/l) | 0 | 0.10 | 0.2 | 0.1 | 0.05 | 0.07 | 0.15 |
| $Cr^{3+}/Cr^{6+}$ (wt. ratio) | 0 | 0.33 | 0.4 | 0.5 | 0.2 | 0.35 | 0.5 |
| $PO_4^{3-}$ (g/l) | — | — | — | — | 1.0 | 0.5 | — |
| Colloidal Silica (g/l) | — | — | — | — | — | 2.0 | — |
| Water soluble polymer (g/l) | — | — | — | — | — | — | 1.0 |
| Electrolysis condition | | | | | | | |
| pH | 3.8 | 4.0 | 4.2 | 4.0 | 4.2 | 3.8 | 4.5 |
| Temp. (°C.) | 35 | 30 | 40 | 30 | 35 | 30 | 20 |
| Current Density (A/dm$^2$) | 0.04 | 0.12 | 0.06 | 0.04 | 0.24 | 0.12 | 0.06 |
| Coulomb/dm$^2$ passed | 1.3 | 3.5 | 4.2 | 2.2 | 3.4 | 1.1 | 2.1 |
| Time (seconds) | 20 | 30 | 60 | 30 | 20 | 10 | 30 |
| Cr amount in the coating (mg/m2) | 10.3 | 12.7 | 18.5 | 9.4 | 4.5 | 4.1 | 25.0 |

TABLE 1B

| | Comparative Example | | | | |
|---|---|---|---|---|---|
| | 1 | 2 | 3 | 4 | 5 |
| Steel Sheet | EG | EG | CRS | Electro-Zn/Ni | CRS(Cleaning only) |
| Solution composition of chromate post-treatment | | | | | |
| $Cr^{6+}$ ion (g/l) | 0.2 | 12.0 | 0.3 | 0.5 | 0.3 |
| $Cr^{3+}$ ion (g/l) | 0.3 | 1.0 | 0.12 | 0.2 | 0.12 |
| $Cr^{3+}/Cr^{6+}$ (wt. ratio) | 1.5 | 0.083 | 0.4 | 0.4 | 0.4 |
| $PO_4^{3-}$ (g/l) | — | — | — | — | — |
| Colloidal Silica (g/l) | — | — | — | — | — |
| Water soluble polymer (g/l) | — | — | — | — | — |
| Electrolysis condition | | | | | |

TABLE 1B-continued

| | Comparative Example | | | | |
|---|---|---|---|---|---|
| Steel Sheet | 1 EG | 2 EG | 3 CRS | 4 Electro-Zn/Ni | 5 CRS(Cleaning only) |
| pH | 4.0 | 3.0 | 3.8 | 4.2 | 4.0 |
| Temp. (°C.) | 35 | 30 | 35 | 40 | 35 |
| Current Density (A/dm$^2$) | 0.12 | 0.12 | — | — | — |
| Coulomb/dm$^2$ passed | 2.4 | 1.8 | — | — | — |
| Time (seconds) | 20 | 10 | 20 | 60 | 20 |
| Cr amount in the coating (mg/m2) | 2.0 | 35.1 | 1.7 | 2.3 | 1.5 |

TABLE 2A

| | Example | | | | | | |
|---|---|---|---|---|---|---|---|
| Paint film appearance | 1 Good | 2 Good | 3 Good | 4 Good | 5 Good | 6 Good | 7 Good |
| ED film only | | | | | | | |
| (Note 1) Salt spray test (Blister width from scribe) | 2.5 | 3.2 | 2.6 | 2.0 | 2.3 | 2.5 | 2.2 |
| (Note 2) Salt spray test (Blister width from edge) | 2.3 | 2.8 | 2.5 | 2.0 | 2.0 | 2.2 | 2.1 |
| 3 - coat | | | | | | | |
| (Note 3) Wet adhesion | 100 | 100 | 100 | 100 | 100 | 100 | 100 |
| (Note 4) Resistance to chipping damage | A | A | A | A | A | A | A |
| (Note 5) Composite cycle test | A | A | A | A | A | A | A |

TABLE 2B

| | Comparative Example | | | | |
|---|---|---|---|---|---|
| Paint film appearance | 1 Good | 2 Poor | 3 Good | 4 Good | 5 Good |
| ED film only | | | | | |
| (Note 1) Salt spray test (Blister width from scribe) | 9.0 | 2.5 | 5.7 | 9.5 | 7.0 |
| (Note 2) Salt spray test (Blister width from edge) | 8.5 | 2.0 | 5.0 | 10.3 | 6.5 |
| 3 - coat | | | | | |
| (Note 3) Wet adhesion | 92 | 80 | 100 | 85 | 95 |
| (Note 4) Resistance to chipping damage | B | A | B | C | B |
| (Note 5) Composite cycle test | B | A | B | D | C |

(Note 1):

Electropainted panel cross-hatched on paint film is subjected to 5% salt spray test (JIS-Z-2371) for 1000 hours. Blistering of paint film taking place along the scribe is denoted in mm for the width across the scribe.

(Note 2):

The same test as in (Note 1). Blister width from test panel edge is indicated in mm.

(Note 3):

Test panels after electropainting intermediate coating and top coating are dipped in DI water at 40° C. for ten days. These panels are cross-cut to 100 2 mm squares with a standard knife so that the scribes reach base metal surface. They are then subjected to Cellophane Tape peeling off test. The number of squares remaining unpeeled is counted.

(Note 4):

Test panels treated in advance with phosphate coating, cathodic electrocoating, intermediate coating and top coating then left standing for 24 hours at room temperature are soaked for 120 hours in DI water maintained at 40±1° C.

Precaution is taken so that the test panels do not come into contact with each other. Then they are taken out and air-dried for one hour at room temperature. After that they are set fixed so that the painted faces take upward position with 45° inclination to horizontal, then subjected to chipping test in the following manner: 100 pieces of ¼ inch nut (total weight: 198±0.5 g) pass by gravity fall through a guide tube of 2′ $\phi$ from the height measuring 4.5 m from the center of test panel and impinge the paint film surface at 90° direction to the horizontal. Chipping damage thus made on the paint film of the test panel is visually observed for the state of paint film peeled off.

State of paint film peeled off from base metal

A—Few (High resistance to chipping damage)

B—Medium

C—Many (Low resistance to chipping damage)

(Note 5):

Test panels chip-damaged according to the above-mentioned method are subjected to 5% salt spray test (JIS-Z-2371) for 72 hours. They are taken out and exposed to outdoor atmosphere. This cycle is repeated four times and then the test panels again undergo the above-mentioned salt spray test for 72 hours.

The test panels taken out from the cabinet are scraped with metal scraper to remove corrosion products and paint film blistered on the surface, then subjected to visual inspection for the degree of paint film peeled off.

Degree of paint film peeled off

A—Very few

B—Few

C—Somewhat many

D—Very many

As explained in the above the post-treatment method of phosphate treated surfaces offered by the present invention provides excellent corrosion resistance, after-painting corrosion resistance, and paint adhesion, wherein controlling the current density, time length for the electrolysis or coulomb quantity can lead to a prescribed value of chromium amount in the coating which directly governs the above-mentioned corrosion resistance. Further, the above-mentioned electrolysis has an effect of removing relatively soft portions existing on the zinc phosphate base crystal coating formed on the surface, owing to which further effect can be exerted on improving paint adhesion.

What is claimed is:

1. A process for the post-treatment of a phosphated metal surface prior to painting comprising immersing the surface as cathode in an aqueous chromating solution containing 0.05–10 g/l of hexavalent chromium and having a weight ratio of $Cr^{3+}/Cr^{6+}$ of less than 1.0.

2. The process of claim 1 wherein the chromating solution additionally contains colloidal silica at a concentration of from 0.01 to 5.0 g/l.

3. The process of claim 1 wherein the chromating solution contains phosphate ion at a concentration of from 0.01 to 2.0 g/l.

4. The process of claim 1 wherein the chromating solution contains a water soluble organic polymer at a concentration as dry solid of from 0.01–5.0 g/l.

5. The process of claim 4 wherein the water soluble polymer comprises at least one polymer selected from among the polyacrylate base polymers and the polyurethane base polymers.

6. The process of claim 1 wherein the chromating solution is adjusted in pH to a value of from 1.5–5.0.

7. The process of claim 1 wherein the chromating solution is maintained at a temperature between ambient temperature and 50° C.

8. The process of claim 1 wherein the surface is electrolyzed at a rate and for a time sufficient to form a coating weight of from 4 to 100 $mg/m^2$ as chromium.

9. The process of claim 1 wherein the post-treatment comprises the sequence that the electrolysis in the chromating solution is followed by water rinsing.

10. The process of claim 9 wherein subsequent to the water rinsing the surface is dried.

11. The process of any one of claims 1 to 10 wherein the electrolysis treatment is carried out at an electric current density from 0.01 to 0.5 $Amp/dm^2$.

12. The process of any one claims 1 to 10 wherein the electrolysis treatment is carried out for a time length from 2 to 120 seconds.

13. The process of any one of claims 1 to 10 wherein the quantity of electricity for carrying out the electrolysis treatment is 0.2–30 $coulomb/dm^2$.

* * * * *